US007077925B2

(12) United States Patent
Vandevoorde et al.

(10) Patent No.: US 7,077,925 B2
(45) Date of Patent: Jul. 18, 2006

(54) METHOD OF FITTING PRODUCTS WITH STRETCHABLE SLEEVES

(75) Inventors: Jean-Claude René Vandevoorde, Montdidier (FR); Philippe Jacques Thebault, Montdidier (FR)

(73) Assignee: Protection Decoration Conditionnement Europe, Montdidier (FR)

( * ) Notice: Subject to any disclaimer, the term of this patent is extended or adjusted under 35 U.S.C. 154(b) by 316 days.

(21) Appl. No.: 10/744,367

(22) Filed: Dec. 23, 2003

(65) Prior Publication Data

US 2004/0182501 A1 Sep. 23, 2004

(30) Foreign Application Priority Data

Dec. 24, 2002 (FR) ..... 02 16642

(51) Int. Cl.
*B65B 41/12* (2006.01)

(52) U.S. Cl. ..... 156/204; 156/199; 156/213; 156/294; 156/256; 53/556; 53/389.3

(58) Field of Classification Search ..... 156/199, 156/204, 212, 213, 239, 294, 85, 86, 517, 156/543, 556, 459, 461, 464; 53/556, 567, 53/389.4, 389.3, 442
See application file for complete search history.

(56) References Cited

U.S. PATENT DOCUMENTS

| | | | | |
|---|---|---|---|---|
| 4,237,676 | A * | 12/1980 | Buckingham et al. | 53/398 |
| 6,080,093 | A | 6/2000 | Henderson et al. | |
| 2002/0160896 | A1 | 10/2002 | Tseng et al. | |

FOREIGN PATENT DOCUMENTS

| | | | |
|---|---|---|---|
| DE | 8113736 | U1 | 10/1981 |
| EP | 0292018 | A2 | 11/1988 |
| EP | 0368663 | A1 | 5/1990 |
| FR | 2738797 | A1 | 3/1997 |
| FR | 2785255 | A1 | 5/2000 |

* cited by examiner

*Primary Examiner*—Sam Chuan Yao
*Assistant Examiner*—Barbara J Musser
(74) *Attorney, Agent, or Firm*—Drinker Biddle&Reath LLP

(57) ABSTRACT

Method of fitting products with stretchable sleeves. A stretchable sheath is placed on a reel by forming a tubular sheath made from a stretchable plastic material of the dimension required to fit the product, flattening the sheath whilst forming a gusset in each side of the contour to reduce the width of the flattened sheath, and winding the sheath onto a reel. The stretchable sleeves are placed on the products by unreeling the sheath with its gussets, aligning the sheath with the production line, feeding the flat sheath into the cutter in order to cut a sleeve, and picking up the cut sleeve in order to place it on the product.

2 Claims, 3 Drawing Sheets

METHOD OF FITTING PRODUCTS WITH STRETCHABLE SLEEVES

FIELD OF THE INVENTION

Figure 1:
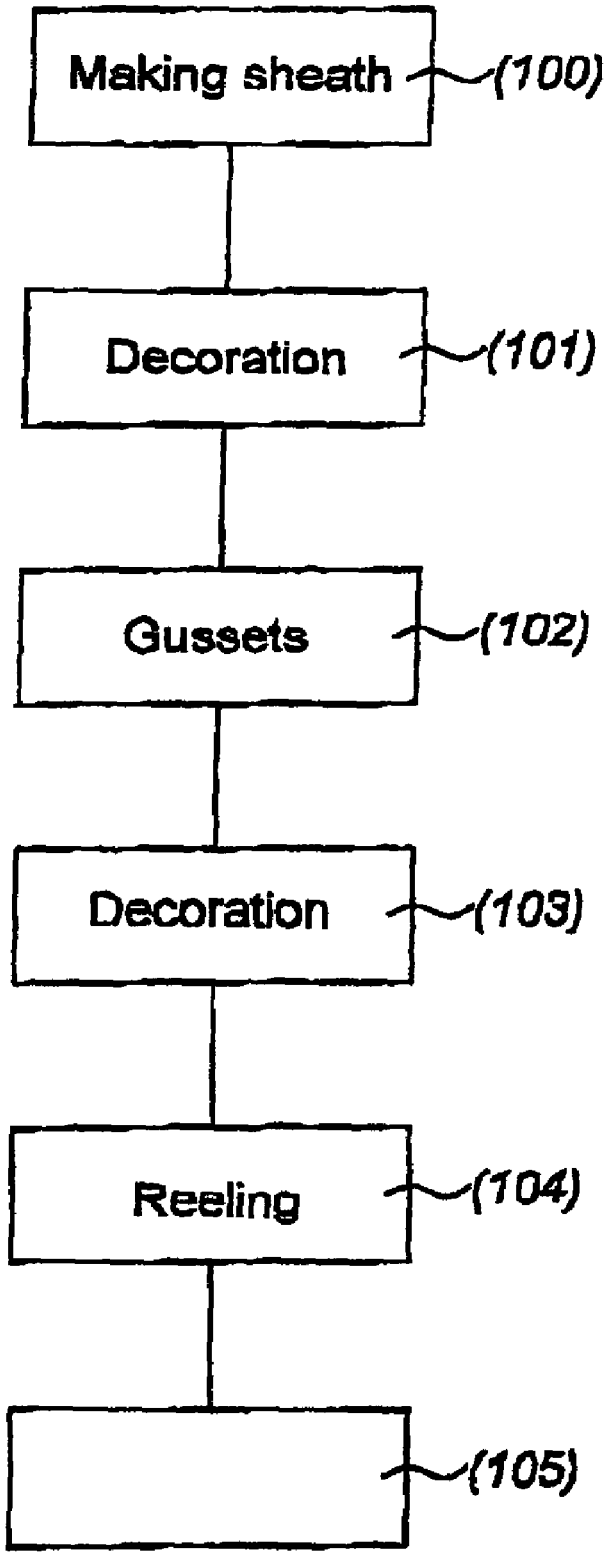

The present invention relates to a method of fitting products with stretchable sleeves made from a sheath.

PRIOR ART

The idea of fitting products, such as bottles made from a very thin plastic, with stretchable sleeves which are placed over the neck of the bottle and lowered down to a given position on the body is already known.

These sleeves have a relatively reduced perimeter because products such as bottles have a relatively small section, irrespective of their capacity.

For various reasons, it would be useful to be able to place sleeves on products with a much bigger section or perimeter than bottles, such as containers in the shape of a box, both in order to strengthen them by means of the sleeve and to enable the entire periphery of the box to be used as a surface for applying advertising material, the brand or other decorative elements in order to make maximum use of the available side surface, independently of any printed information which might be provided on the lid, so that the product can be displayed in any position, stacked or upright, in retail display areas.

Such products, which might have a polygonal, round or rectangular cross section, have a relatively large periphery, which means that the stretchable sheath from which the sleeves are cut will be quite large in terms of its width when wound flat on a reel. Since the machinery currently used to apply sleeves is relatively small in width due to the fact that the sheath and sleeve have a small width, it would be no easy matter to adapt it or to use some of the existing components of the machinery as a means of fitting sleeves on products with a relatively large section.

OBJECTIVE AND ADVANTAGES OF THE INVENTION

The objective of the present invention is to develop a method of fitting products, in particular products with a large or relatively large section, with stretchable sleeves that will make it easy to open out the sleeve or, more generally, the length of sheath and simplify the equipment needed to fit such a sleeve.

To this end, the invention relates to a method of fitting products with stretchable sleeves, characterised in that A. a stretchable sheath is placed on a reel by
- forming a tubular sheath made from a stretchable plastic material of the dimension required to fit the product,
- flattening the sheath whilst forming a gusset in each side of the contour to reduce the width of the flattened sheath,
- winding the sheath onto a reel and B. the stretchable sleeves are placed on the products:
- by unreeling the sheath with its gussets,
- aligning the sheath with the production line,
- feeding the flat sheath into the cutter in order to cut a sleeve,
- picking up the cut sleeve in order to place it on the product.

The invention also relates to an apparatus for fitting products with stretchable sleeves obtained from a sheet wound so as to incorporate gussets, this apparatus being characterised in that it comprises
- a reel mount to accommodate the reel loaded with the sheath incorporating gussets,
- a drive device with driver wheel and press wheel between which the flat sheath with its gussets is fed,
- a length compensator upstream and downstream of the drive device in order to hold the sheath taut,
- an aligner with a rotating frame receiving the sheath as it leaves the second compensator in order to align the sheath with the production line,
- a sensor to detect the transverse position of the sheath in order to control the aligner,
- a driver roll and a press wheel as well as a guillotine cutter to sever the sleeves, one by one, from the flat sheath with gussets and
- means for transferring and placing the sleeves on the products.

The fact that the sheath is reeled flat and incorporates two gussets reduces the width of the apparatus used to supply the sheath and cut it into lengths (sleeves). The reel will be very much smaller in width than it would be if the sheath were laid flat without gussets; the same applies to the various items of apparatus downstream of the reel, such as rollers or wheels for guiding and driving the sheath, the centring means as well as the cutter. This saving on the width of the equipment is of additional importance because it also reduces bulk and moving masses, thereby permitting more flexible and more accurate operation.

Furthermore, the gussets, which sit within the volume of the sheath, create spacer elements which prevent the two internal faces of the flattened sheath from sticking across their entire surface, which would make it difficult to open the sheath or would require special means to open it, such as introducing a shaper into the sheath before feeding it into the cutter.

A shaper, which is a component with two guide surfaces directed upstream in the feed direction of the sheath, is positioned inside the sheath in a floating arrangement at the instant the sheath is fed into the apparatus. At its rear part, the shaper is supported to a greater or lesser degree on the rollers driving the sheath at the input to the cutter located downstream. It enables adhered surfaces of a flat sheath to be mechanically moved apart.

Fitting a shaper requires a certain amount of time when changing sheath format because this shaper has to be adapted to the sheath format.

The shaper also occupies a not inconsiderable amount of space upstream of the drive rollers at the input of the cutter, and dispensing with the shaper enables the length of the feed path for the sheath to be reduced upstream of the cutter.

All in all, using a stretchable sheath incorporating gussets considerably reduces the space occupied by the machinery, both in terms of width and height, reducing the cost of parts and facilitating preparation of the machine with every change of sheath format.

Whilst the method and apparatus of the invention are of particular advantage when used for sheaths with a relatively large section, and in particular very much bigger than that of sleeved bottles, the invention may also be used to advantage with these sleeves as well, because the fact of making gussets in the sheath makes it easier to open the sheath out and again obviates the need for the shaper.

By virtue of one feature of the invention, the sheath is printed before it is flattened and the gussets are formed.

As a result of another advantageous feature, because the sheath is made from a tube of much bigger dimensions, the section of the sheath being dependent on the section of the product to be fitted, it is of advantage to position the longitudinal weld seam of the sheath in a precise manner and to do so, by preference, at the edge of a gusset.

DRAWINGS

Figure 2:
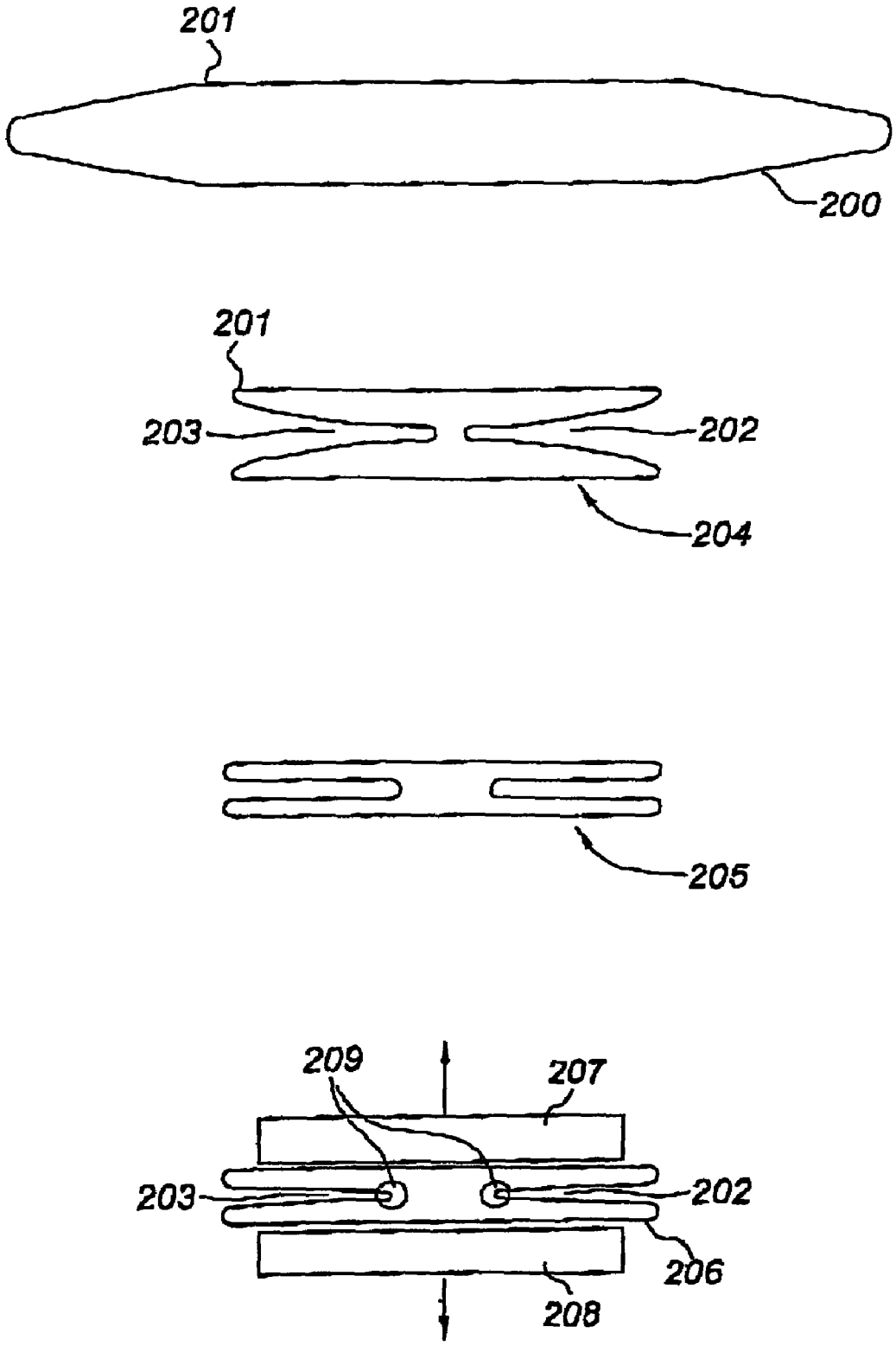
Figure 3:
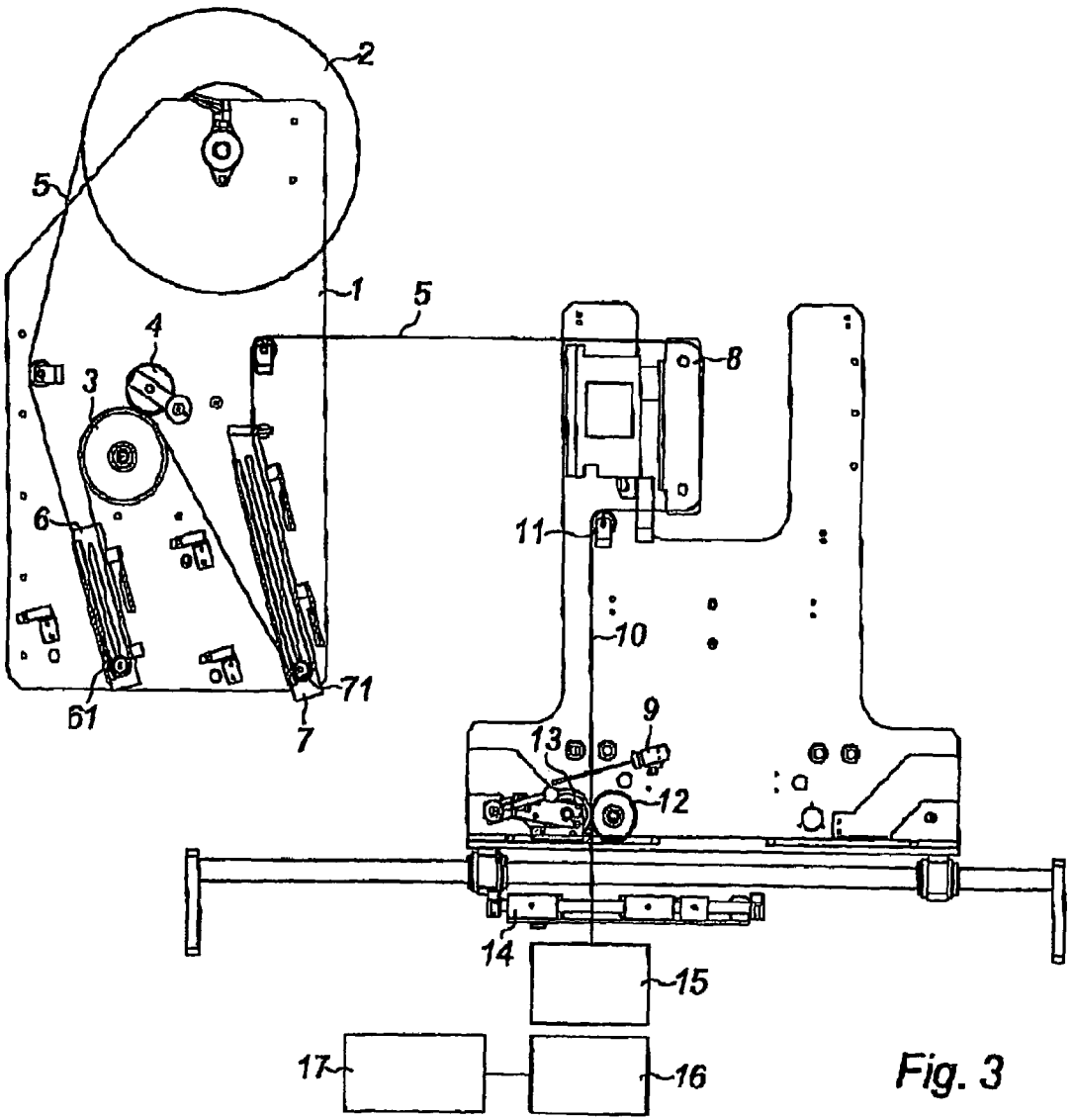

The present invention will be described in more detail below with reference to the appended drawings, in which:

FIG. 1 is a flow chart depicting the process of fitting a product with stretchable sleeves as proposed by the invention, FIG. 2 illustrates different sections of a sheath proposed by the invention, FIG. 3 depicts apparatus for fitting sleeves using a sheath as proposed by the invention.

DESCRIPTION OF AN EMBODIMENT OF THE INVENTION

As illustrated in FIG. 1, the invention relates to a method of fitting products with stretchable sleeves. These products are not illustrated: as mentioned above, they might be containers or boxes with a certain section which it is desirable to fit with a stretchable sleeve around the periphery. They might also be products with a smaller section, such as bottles.

For the purposes of the invention, a sheath is made (100) with the requisite section depending on that of the product on which a sleeve is to be placed. This section is smaller than that of the product because the sheath is stretchable and clings to the product, in particular due to elasticity and tension.

Once the sheath has been made from a sheath of film of larger dimensions by applying a longitudinal weld seam, the periphery of the sheath is decorated (101) to apply the information and decoration which is to be disposed on the sleeves.

After decoration, which involves various printing processes followed by drying the print, two gussets are formed at the side edges of the sheath and the sheath is placed flat (102). Once the gussets have been formed and the sheath placed flat, more decoration may optionally be applied to the sheath (103).

After this step (103), the sheath is reeled (104).

The sheath can then be cut into sleeves following the pitch of the sleeves as determined by the decorative elements and print associated with each sleeve and the sheath is fitted (105).

FIG. 2 illustrates different sections of the sheath during the process described above.

In phase (100), for example, the sheath is in the shape of a sleeve 200, which is not flat and has no gussets. This sleeve has a longitudinal weld seam 201.

Side folds 202, 203 are then formed to obtain shape 204 of the sheath.

The shape is flat and gussets 205 are incorporated in the sheath.

After cutting a sleeve with a sheath section 206, the sheath is opened up by means of gripper elements 207, 208 acting in the direction of the two arrows. This opening process can be operated very simply with nothing more than these two elements because the presence of the gussets 202, 203 prevents the internal faces of the sheath from totally sticking to one another by already creating regions on a level with the tips of the folds that are not stuck (parts enclosed in a circle 209). This easy opening process obviates the need for a shaper, which would otherwise have to be introduced into the sheath and remain there in a floating arrangement upstream of the cutter.

FIG. 3 is a schematic diagram showing apparatus used to fit sleeves obtained from a gusseted sheath. This apparatus comprises a mount 1 to accommodate a reel 2 wound with the gusseted sheath. At the outlet of the reel 2, the machine has a driver wheel 3 and a press wheel 4, between which the sheath 5 is fed. Upstream and downstream of the driver wheel is an upstream magazine 6 and a downstream magazine 7 to compensate for surplus lengths caused by the inertia of the reel 2 relative to the driver wheel 3 and the downstream apparatus. In very schematic terms, these magazines 6, 7 comprise a roller 61, 71 around which the sheath is fed. This roller is tensed so as to apply a constant tension to the length of sheath upstream and downstream of the driver wheel 3. The roller 61, 71 is then displaced in the magazine and instantaneously takes up the extra length of sheath 5 or pushes it back.

At the output of the downstream magazine 7, the sheath 5 is fed through an aligner 8 with a rotating frame. In very schematic terms, this known device has a pivoting unit fitted with two rollers on which the sheath is fed. The pivoting motion of this unit, controlled by means of a sensor 9 positioned downstream, enables the sheath to be guided on the right or on the left-hand side (in a direction perpendicular to the plane of the drawing) by the return roller 11 so as to be aligned with the production line 10 on leaving the aligner with rotating frame 8 so that the sheath 5 is accurately centred relative to the production line 10 passing across the driver roller 12 and its press wheel 13 positioned at the inlet to the cutter 14, which in this instance is a guillotine cutter. The sleeves cut from the sheath by the cutter 14 then arrive at the part where the sleeves are picked up 15 and fitted 16. This part is not illustrated in detail. It has lifting elements which pick up the sleeves one by one as they leave the cutter in order to open them, place them on a fitting unit with stretcher elements, which stretch the sheath to a section that is bigger than that of the product on which the sleeve is to be placed. A feed 17 is also provided for the products as they arrive in the fitting zone, where the sleeves are placed one by one on the products.

The invention claimed is:

1. Method of fitting products with stretchable sleeves, comprising forming a tubular sheath from a elastic plastic material of the dimension required to fit the product, printing the sheath, after printing the sheath, flattening the sheath whilst forming a gusset in each side of the contour to reduce the width of the flattened sheath, winding the sheath onto a reel, unreeling the sheath with its gussets, aligning the sheath with the production line, feeding the fiat sheath into a cutter in order to cut a sleeve, picking up the cut sleeve stretching the cut sleeve, and placing the cut sleeve on the product.

2. Method as claimed in claim 1, wherein the tubular sheath has a longitudinal weld seam, comprising positioning the weld seam of the sheath precisely relative to the contour of the flattened sheath.

* * * * *